United States Patent [19]

Dang

[11] Patent Number: 4,750,738

[45] Date of Patent: Jun. 14, 1988

[54] PHYSICAL EXERCISE APPARATUS FOR ISOKINETIC AND ECCENTRIC TRAINING

[76] Inventor: Chi H. Dang, 3897 Birchwood Dr., Boulder, Colo. 80302

[21] Appl. No.: 19,501

[22] Filed: Feb. 26, 1987

[51] Int. Cl.[4] ..... A63B 21/00

[52] U.S. Cl. ..... 272/125; 272/129

[58] Field of Search ..... 272/125, 129

[56] References Cited

U.S. PATENT DOCUMENTS 3,572,700 3/1971 Mastropaolo ..... 272/129

4,261,562 4/1981 Flavell ..... 272/129

*Primary Examiner*—Leo P. Picard

[57] ABSTRACT

A physical exercise apparatus for isokinetic and eccentric training which employs a permanent magnet electric motor/generator as the means for generating positive and negative loads. An electrical braking circuit which employs zener diodes governs the speed of a permanent magnet electric generator by providing a sharp increase of resisting torque with increasing rotation speed when the rotation speed reaches a predetermined value.

6 Claims, 6 Drawing Sheets

PHYSICAL EXERCISE APPARATUS FOR ISOKINETIC AND ECCENTRIC TRAINING

BACKGROUND OF THE INVENTION

The present invention relates to physical exercise equipment, in particular to a novel apparatus for strength training.

In strength training, the isokinetic technique which requires movement at constant speed and at peak force throughout the full range of motion is proven to be most effective. Hydraulic cylinders are commonly used in this type of exercise equipment. Since its generated resistance increases with increasing speed, it can provide to the user the resistance up to his maximum capacity and limit his motion to the speed determined by his peak force. The employment of hydraulic cylinders has the following major short comings:

* The speed of the motion is difficult to set and monitor without a sophisticated and expensive control system.

* At high speed operation, the device must be set so that the resistance increases gradually with the increasing speed. Therefore, any slight change of force can produce a large variation in speed; as a result, the motion is not truly isokinetic.

* Resistance is a function of the speed, therefore at the beginning of the motion, there is no resistance generated to provide a desirable prestretch which is required to mobilize more muscle fibers into the contraction.

* It does not provide resistance as the muscles extend. This eccentric exercise technique in which the muscles are subjected to tension as they extend is very important in some training programs for many sports.

In eccentric training, the muscles need to extend slowly under applied force at near muscle peak resisting capacity. Generally the muscle can resist a load of 40% higher than its pulling capacity. Therefore, to train with this technique using weight as a means of generating negative load, the trainee needs to have an assistant to move the load to the starting point of each repetition. Beside the inconvenience, it can be very dangerous if the trainee gets fatigues and cannot withstand the load during the routine.

The present invention provides a novel approach to isokinetic and eccentric strength training exercise equipment which resolves all of the above shortcomings.

SUMMARY OF THE INVENTION AND OBJECTS

The object of this invention is to provide a strength training exercise equipment that assists the user to train with isokinetic and eccentric techniques, but without the drawbacks which are found in the presently available isokinetic and eccentric machines.

The apparatus of the present invention comprises of a permanent magnet electric motor/generator as a means of generating positive resistance (in generator mode) for isokinetic and negative load (in motor mode) for eccentric training, an electrical braking circuit to govern the speed of the motion without the requirement of external electrical power or battery, and an electrical system to supply the electrical power to the electric motor/generator to generate negative load at proper time and sequence.

This and other objects and advantages of this invention will become apparent through examining the following description of the arrangement and construction of the constituent components and the operating principle and appended claims in conjunction with the attached drawings.

DESCRIPTION OF THE PREFERRED EMBODIMENT

Figure 1:
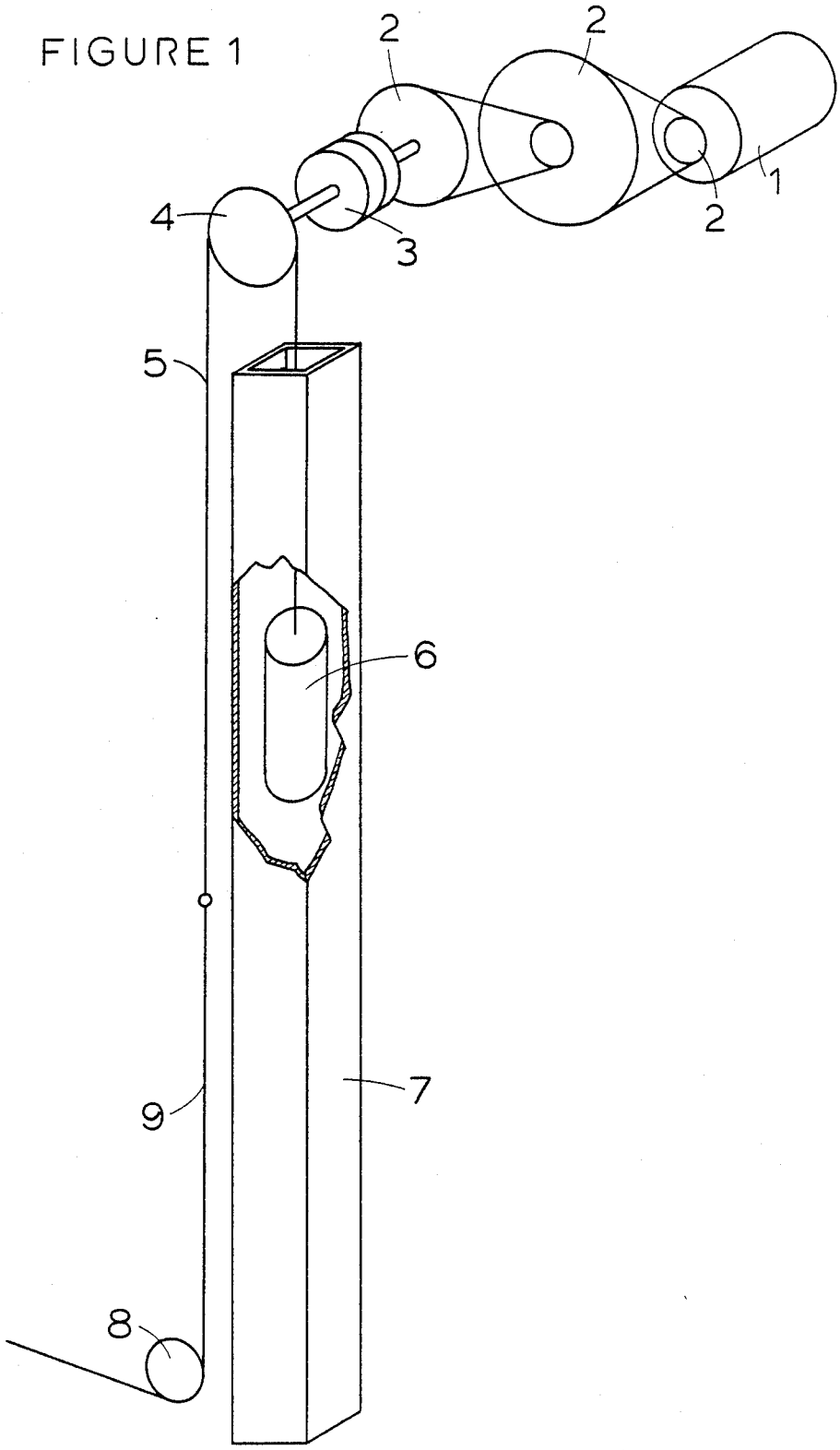
FIG. 1 is a schematic partial illustration of a physical exercise apparatus that can be employed in the present invention.

Referring now to FIG. 1, the mechanical portion of the preferred embodiment of present invention comprises:

* A permanent magnet electric motor/generator 1,

* A rotary speed reducing means 2 which high speed output shaft is connected to the output shaft of the permanent magnet electric motor/generator 1,

* A single direction rotary clutch 3 which input and output shafts are connected if the rotation is in the clutching direction, and are disconnected if the rotation is in the opposite. The input shaft of the single direction clutch 3 is connected to the low speed output shaft of the rotary speed reducing means 2,

* A chain sprocket 4 which is mounted to the output shaft of the single direction rotary clutch 3,

* A chain 5 which wraps around a portion of the chain sprocket 4. If the chain 5 is pulled by the end which is referred as the active end, it rotates the single direction clutch 3 in the clutching direction. The other end is referred as the returning end,

* A weight 6 which is attached to the returning end of the chain 5, it can be replaced by any other type of energy storing means such as springs, air cylinder . . . ,

* A post 7 which is erected in a vertical direction with respect to the floor,

* An idle pulley 8 which is mounted at the lower end of the post 7,

* A cable 9 which loops through the idle pulley 8, one of its ends is connected to the chain 5, the other is pulled by the user.

All components including the electric motor/generator 1, rotary speed reducer 2, single direction rotary clutch 3, chain sprocket 4, are rigidly mounted to the upper end of the post 7 in a manner so that the axial direction of the chain sprocket 4 is perpendicular to the post 7. In such configuration, the chain 5 wraps around the upper half portion of the chain sprocket 4, while each of its ends is hung downward in a parallel direction with the post 7. The returning end of the chain 5 is always pulled downward by the weight 6. While its active end is pulled downward by the user through the cable 9. The post 7 can be employed as the guiding means for the weight 6. If the post 7 is a rigid tube, its inner channel can serve as the guiding and protection means for the weight 6.

Figure 2:
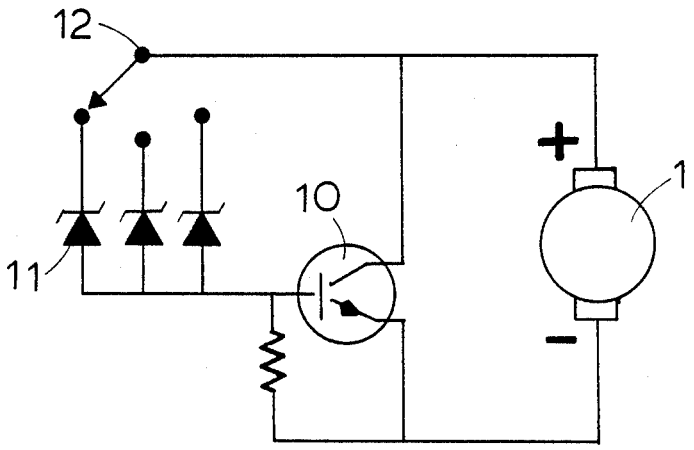
FIG. 2 is a schematic partial illustration of an electrical braking circuit for governing the rotation speed of an direct current permanent magnet generator.

Referred to FIG. 2, the electrical braking circuit of the present invention to govern the speed of the motor/generator 1 when it is operated in generator mode comprises:

* A transistor 10 which collector and emitter are connected to each of the terminals of the permanent magnet electric motor/generator 1,

* An array of zener diode 11, which contains many zener diodes, each with a different zener potential. The anode terminals of the zener diodes are connected to the base of the transistor 10,

* A selective switch 12 which common terminal is connected to the collector of the transistor 10 and each of its position terminals is connected to the cathode of each zener diode of the zener diode array 11.

Figure 3:
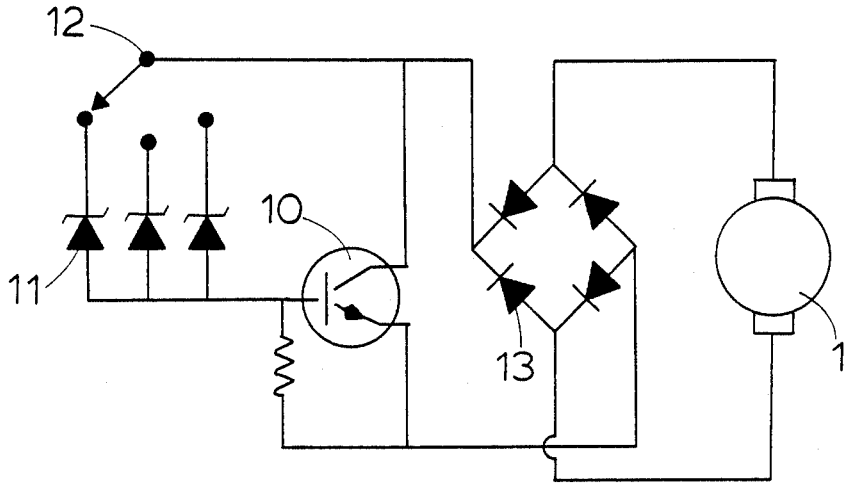
FIG. 3 is a schematic partial illustration of an electrical braking circuit for governing the rotation speed of an alternating current permanent magnet generator.
Figure 5:
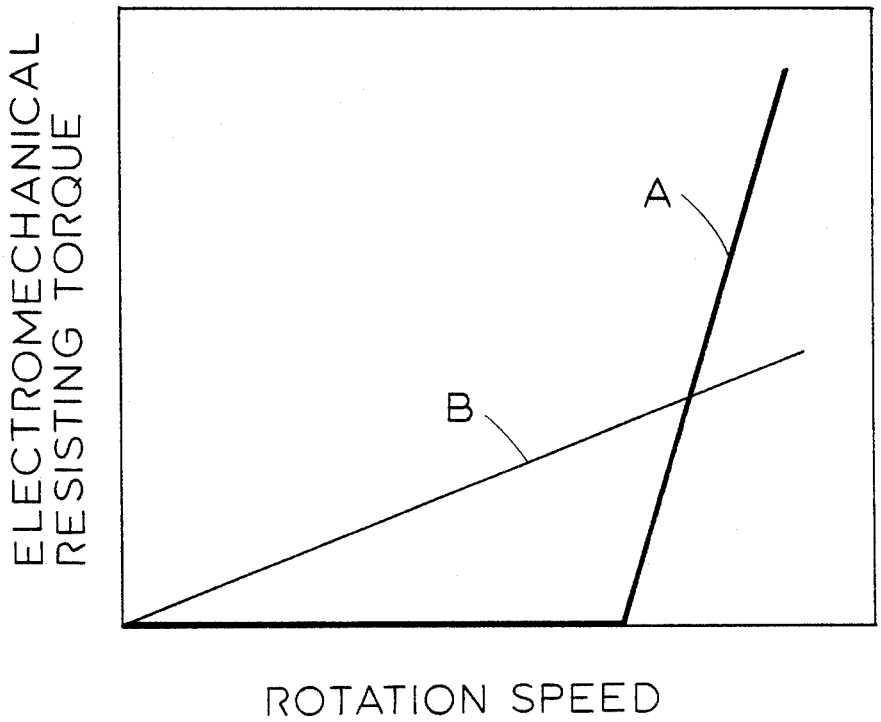
FIG. 5 is a graph showing the response of the resisting torque of an electric generator to the rotation speed, when it is governed by the electrical braking circuit of the present invention and by a simple resistive load.

As the electric motor/generator 1 is rotated by an external torque, it generates an electrical potential across its terminal, this potential increases with increasing speed. The current flowing through the circuit remains minimal until the voltage reaches the zener potential of the zener diodes that is connecting between the collector and base of the transistor 10, then it increases proportionally with the speed. As a result, the generated electromechanical resisting torque which is generated by the current flowing through the electric motor/generator 1 remains small until the electric motor/generator 1 reaches the speed that can produce the voltage higher than the zener potential. The response of the electromechanical resisting torque to the rotation speed provided by the braking circuit of the present invention is compared to that provided by a simple resistive load in FIG. 5, both are illustrated by the curves A and B respectively. If the motor/generator 1 is a direct current unit, the above controlling circuit is functional. But if it is an alternating current unit, a rectifying circuit 13 is inserted between the two terminals of the electric motor/generator 1 and the collector and the emitter of the transistor 10 to convert the alternating current voltage into direct current voltage, as shown in FIG. 3. For certain applications, a gradual and continuous response of the resisting torque to rotation speed is desired, then the zener diode array 11 is replaced by an adjustable resistor.

Figure 4:
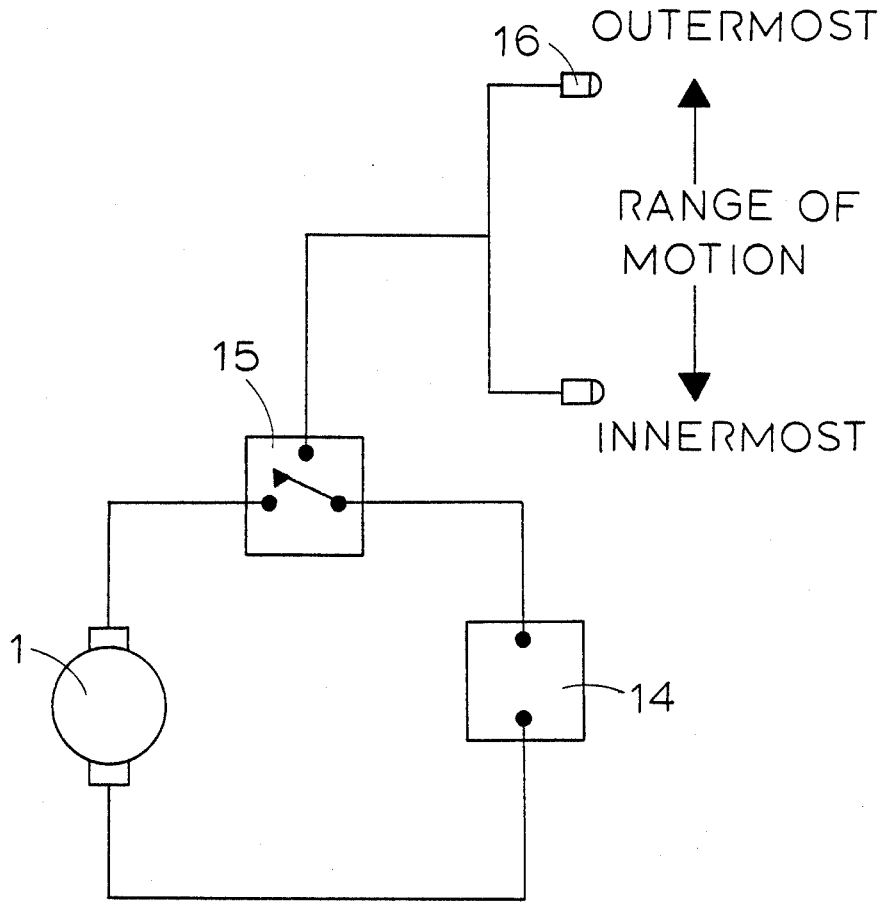
FIG. 4 is a schematic partial illustration of an electrical system for controlling an electric motor which is employed as a means to generate negative load in the eccentric training.

Referred to FIG. 4, the electrical system of the present invention to control the speed, output torque, timing and sequencing of the electric motor/generator 1 when it is operated in motor mode comprises:

* An electrical power supply means 14 which supplies to the electric motor/generator 1 the electrical power required for generating the negative load, its output voltage and output current limiting setting is adjustable to provide different pulling speed and force. Under no load (from the user) condition, the highest voltage setting must not cause the electric motor/generator 1 to rotate the input shaft of the single direction clutch 3 at a speed higher than that of the chain sprocket 4 which rotation is caused by the retracting force of the weight 6,

* A switching means 15 which is to connect and disconnect the electrical power from the power supply means 14 to the electric motor/generator 1,

* A detecting means 16 to detect the innermost and the outermost limits of the range of the motion. The innermost limit detection disconnects and the outermost detection connects the switching means 15 (the switching means 15 is connected when the outermost limit is detected, it stays connected until the innermost limit is detected, then it is disconnected and remains disconnected until the outermost limit is detected). The detecting means 16 can be a pair of proximity switches or any displacement sensor. A combination of a proximity switch for innermost limit detection and a timer for determining the outermost limit is also suitable.

DESCRIPTION OF THE OPERATING PRINCIPLE

Figure 6:
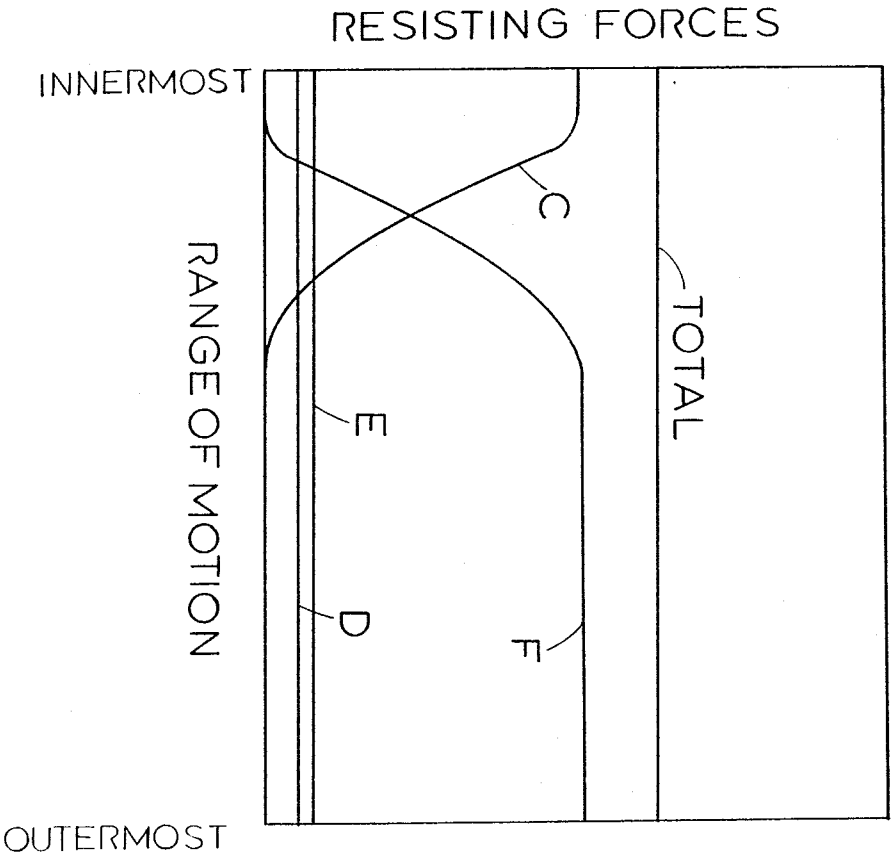
FIG. 6 is a graph showing the components of resisting force provided by the apparatus of the present invention during isokinetic exercises.

In isokinetic training, the electric motor/generator 1 functions as a generator. As the user pulls on the cable 9, the chain sprocket 4 rotates the single direction rotary clutch 3 in its clutching direction, as a result, the electric motor/generator 1 gets rotated and generates a resisting force against the user. During the motion, the use is subjected to the four following resisting forces which are illustrated by the curves C, D, E and F in FIG. 6:

* The accelerating force C which is required to accelerate the mass of whole system. This is the major component at the beginning of the motion and vanishes when the speed reaches its steady state. Due to this force, the prestretch that is missing if hydraulic cylinders are used, becomes available.

* The mechanical frictional force D.

* The retracting force E of the weight 6.

* The electromechanical force F which is generated by the electric motor/generator 1. This force remains minimal until the motion reaches the critical speed that rotates the electric motor/generator 1 fast enough to generate an electrical potential higher than the zener potential. As the speed exceeds the critical value, the generated electromechanical force increases proportionally and rapidly with the speed. Due to the rapid increase of resisting force with the motion speed, the motion speed can be closely controlled as the user's peak force varies. The speed of the motion can be predetermined and set at different levels by selecting between the zener diodes with different zener potentials.

When the motion reaches the end limit of its range, the user just simply releases the contraction, lets the muscles extend slowly and returns to the starting point. The weight 6 provides the only force needed to retract the cable 9. The required retracting force is very small because during the retracting period, the single direction clutch 3 disengages the chain sprocket 4 from the speed reducing means 2. Due to the small negative load generated by the retracting force, this apparatus is considered to be safe, because if at any time during the exercise, the user can no longer continue, he just simply releases the cable 9 and lets the system return to the starting point without heavy impact.

In eccentric training, to start the exercise, the user pulls the cable 9 to the outermost limit of the motion, bringing the muscles in training to the most contracted position. The detecting means 16 detects this outermost limit, it connects the switching means 15 to supply power to the electric motor/generator 1 and starts the eccentric contraction. During the eccentric contraction, the user tries to resist the pulling force of the electric motor/generator 1 with his maximum capacity, thus the muscles in training are subjected to tension as they extend. When the cable 9 reaches the innermost limit, the detecting means 16 disconnects the switching means 15 to stop supplying power to the electric motor/generator 1. Any time during the exercise, the user can discontinue the routine by stopping resisting and allowing the cable 9 to return to the innermost limit under the retracting force of the weight 6. Since the retracting speed is higher than that of the pulling provided by the electric motor/generator 1, the user does not get pinned under a high negative load. In bringing the cable 9 to the starting point of an eccentric exercise routine (the outermost limit), the user needs only to overcome the retracting force of the weight 6 and the mechanical friction. Therefore, he can perform an eccentric exercise with a negative load that exceeds his isotonic capacity (muscle develops tension as it contracts) without any human assistance. The cable 9 can bring resistance to the user indirectly through other mechanisms such as wheels, cams rotatable arms for more convenience and effectiveness.

Having described and disclosed my invention, I claim:

1. A physical exercise apparatus which comprises:

(a) a user input means rotated in a direction referred as recoiling direction when the muscles under training extend and in a direction referred as unwinding direction when the muscles under training contract;

(b) an electric motor;

(c) a single direction rotary clutching means connecting the drive shaft of the motor armature to the user input means in an arrangement such that the user input means is free to rotate relative to the motor armature shaft in the recoiling direction;

(d) a recoiling means applying a torque to the user input means in the recoiling direction;

(e) a power supply means supplying electrical power to the electric motor, generating a torque in the recoiling direction, which is substantially greater than the torque generated by the recoiling means;

(f) a means to detect the most contracted state of the muscles under training and to activate the power supply means when the most contracted state is detected;

(g) a means to detect the most extended state of the muscles under training and to deactivate the power supply means when the most extended state is detected.

2. The physical exercise apparatus of claim 1 wherein said power supply means includes means for adjusting electrical voltage and current output limits.

3. A physical exercise apparatus which comprises:

(a) a user input means rotated in a direction referred as recoiling direction when the muscles under training extend and in a direction referred as unwinding direction when the muscles under training contract;

(b) an electric motor;

(c) a speed reducing means, the high speed input shaft of said speed reducing means is connected to the drive shaft of the motor armature;

(d) a single direction rotary clutching means connecting the low speed input shaft of the speed reducing means to the user input means in an arrangement such that the user input means is free to rotate relative to the low speed input shaft of the speed reducing means in the recoiling direction;

(e) a recoiling means applying a torque to the user input means in the recoiling direction;

(f) a power supply means supplying electrical power to the electric motor, generating a torque that rotates the user input means in the recoiling direction, this generated torque is substantially greater than the torque generated by the recoiling means;

(g) a means to detect the most contracted state of the muscles under training and to activate the power supply means when the most contracted state is detected;

(h) a means to detect the most extended state of the muscles under training and to deactivate the power supply means when the most extended state is detected.

4. The physical exercise apparatus of claim 3 wherein said power supply means includes means for adjusting electrical voltage and current output limits.

5. A physical exercise apparatus which comprises:

(a) a user input means rotated in a direction referred as recoiling direction when the muscles under training extend and in a direction referred as unwinding direction when the muscles under training contract;

(b) an electric motor;

(c) a speed reducing means, the high speed input shaft of said speed reducing means is connected to the drive shaft of the motor armature;

(d) a single direction rotary clutching means connecting the low speed input shaft of the speed reducing means to the user input means in an arrangement such that the user input means is free to rotate relative to the low speed input shaft of the speed reducing means in the recoiling direction;

(e) a recoiling means applying a torque to the user input means in the recoiling direction;

(f) a power supply means supplying electrical power to the electric motor, generating a torque that rotates the user input means in the recoiling direction, this generated torque is substantially greater than the torque generated by the recoiling means;

(g) a means to detect the most extended state of the muscles under training, to deactivate the power supply means when the most extended state is detected, and to activate the power supply means after a time delay interval since the detection of the exiting from the most extended state, the time delay interval must be sufficient for bringing the muscles under training from the most extended state to the most contracted state.

6. The physical exercise apparatus of claim 5 wherein said power supply means includes means for adjusting electrical voltage and current output limits.

* * * * *